US006379245B2

(12) United States Patent
De Keller

(10) Patent No.: US 6,379,245 B2
(45) **Date of Patent: *Apr. 30, 2002**

(54) CASINO METHOD AND DEVICE THEREFOR

(76) Inventor: David De Keller, Sweet Valley Farm, Soetvlei Ave, Constantia 7800 Cape Town (ZA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,400

(22) Filed: Sep. 23, 1998

Related U.S. Application Data

(63) Continuation-in-part of application No. 08/526,382, filed on Sep. 11, 1995, now abandoned.

(51) Int. Cl.[7] ..... A63F 1/00
(52) U.S. Cl. ..... 463/13; 273/274; 273/292
(58) Field of Search ..... 273/274, 292, 273/303, 293; 463/11–13

(56) References Cited

U.S. PATENT DOCUMENTS 5,257,789 A * 11/1993 Le Vasseur ..... 273/292 X
5,382,025 A * 1/1995 Sklansky et al. ..... 273/292
5,397,128 A * 3/1995 Hesse et al. ..... 273/292
5,407,208 A * 4/1995 Keller et al. ..... 273/292 X
5,417,430 A * 5/1995 Breeding ..... 273/292 X
5,423,551 A * 6/1995 Stavinsky ..... 273/292 X
5,489,101 A * 2/1996 Moody
5,494,295 A * 2/1996 Potter et al. ..... 273/292
5,540,444 A * 7/1996 Nguyen ..... 273/292
5,556,101 A * 9/1996 Jabro ..... 273/274
5,630,586 A 5/1997 Lowden
5,720,662 A 2/1998 Homes, Jr. et al.
5,810,354 A * 9/1998 Banyai
5,816,915 A * 10/1998 Kadilac
5,823,873 A * 10/1998 Moody
5,845,907 A * 12/1998 Wells
5,908,353 A * 6/1999 Andrews
5,921,549 A * 7/1999 Wilson
6,007,066 A * 12/1999 Moody
6,098,985 A * 8/2000 Moody

FOREIGN PATENT DOCUMENTS

WO 9216269 10/1992
WO 9216269 * 10/1996 ..... 273/292

OTHER PUBLICATIONS

"The way to play" publication of Diagram Group pp. 224–233, Mar. 1976.*

* cited by examiner

*Primary Examiner*—Benjamin H. Layno
*Assistant Examiner*—Vishu K. Mendiratta
(74) *Attorney, Agent, or Firm*—Philip J. Anderson; Anderson & Morishita

(57) ABSTRACT

A method for playing a casino game is set forth wherein, in a table game format, players make an ante and an outcome wager. Each player is dealt a plurality of cards and a plurality of cards, some face up and some face down, are dealt as community cards. Players are given the option of discarding or holding cards and increasing their outcome wagers before revelation of community cards. Ante wagers are won by the player with the highest ranking hand and outcome wager(s) are won based upon a schedule of winning outcomes. For an electronic version, the method includes the player making wagers as indicia are revealed and given the opportunity of holding or discarding indicia during play.

7 Claims, 4 Drawing Sheets

CASINO METHOD AND DEVICE THEREFOR

CROSS-REFERENCE TO RELATED APPLICATION

This application is a continuation-in-part application of application Ser. No. 08/526,382 filed Sep. 11, 1995, now abandoned by the applicant herein and entitled "CASINO POKER GAME".

FIELD OF THE INVENTION

The present invention relates to methods for playing a casino game in the nature of poker using one or more decks of conventional playing cards or other means for selecting indicia and an electronic device therefor.

BACKGROUND OF THE INVENTION

Poker is a popular game throughout the world. It combines principles of card games known for centuries in Europe but in its present form it is distinctly of American origin. There are numerous forms of Poker and the main divisions are: Draw Poker, in which all of a player's cards are unknown to his opponents and Stud Poker, in which some of the player's cards are face up and others face down. Within the above two broad categories numerous variations exist with "Holdem" or "Texas Holdem" being a popular example. In "Holdem" each player makes an ante wager and is dealt two cards face down. After a betting interval three communal cards are dealt face up. A second betting interval follows and the dealer then turns up one more communal card. Another betting round follows after which the dealer turns up the final communal card and the player with the highest Poker ranked hand assembled from their own cards and the four communal cards wins the pot.

In modern casinos the game of Poker takes one of three forms: live or cardroom Poker where players compete against one another but the games are controlled and supervised by a house dealer who removes a house levy either in the form of a participation fee or as a percentage of winning hands; electronic video machines offering various forms of Poker; and Poker played as a "bankers game" either where the game involves players in contest with the dealer's hand or where the object is for the players to obtain a hand based on hierarchical Poker rankings. In both versions of Banker games the house enjoys a favorable advantage based on a paytable that is structured in such a way that the pay-offs are not based on the true mathematical odds, or rules of play so structured that the house has a favorable edge.

The growth in casinos has prompted the introduction of new games and variations to established games. Numerous patents have been granted in this particular field. For example, in U.S. Pat. Nos. 4,836,553 and 4,948,134 (Suttle et al.) a casino type Poker game is disclosed in which players each play against a dealer (a banked game). If a player wins, he receives a bonus payment depending on the Poker rank of his hand. Various patents disclose casino type games where for example a standard deck is modified, for example, U.S. Pat. No. 5,423,551 (Stravinsky) where cards are dealt from two standard decks of fifty two cards plus eighteen special cards; U.S. Pat. No. 5,540,444 (Nguyen) discloses a deck of cards consisting of thirty two cards; U.S. Pat. No. 5,397,128 (Hesse et al.) discloses a casino game where cards are assigned certain values and the object is to hit a total 9 in total count or value.

Various other patents disclose further variations to traditional forms of Poker. Sklansky U.S. Pat. No. 5,382,025 discloses a modification of Texas Holdem whereby players do not compete against one another and whereby players have the opportunity to select their two card hand from a plurality of hands dealt face-up. Breeding U.S. Pat. No. 5,417,430 discloses a Poker banker game in which the players place three bets at the outset but as the game unfolds the players are given the option of withdrawing two of their wagers. Potter et al U.S. Pat. No. 5,494,295 disclose an invention which provides a method whereby a plurality of hand ranking rules can be utilized within a single type wagering game.

It is to be noted that Poker in casinos (excluding video style machines) takes two distinct forms and method of operation; cardroom Poker where players compete against one another and banking type Poker games where players do not compete against one another but against the house either in terms of competing with a dealer or where there is no dealer hand and the object is to reach certain winning combinations. There is a need for a game method where players both compete against one another and against the house and where they have the opportunity to receive bonus payments by achieving certain winning Poker hands/combinations.

With reference to electronic, video casino games the prior art discloses a number of Poker type games. Video Draw Poker is the most widely played of such games. In Video Draw Poker, a player places a wager of 1–5 units and a hand of five cards composed of electronically produced visual representation are displayed on a monitor. The player has the option of discarding some or all of the cards and receiving replacements which are selected by the machine's processor from memory. If the player's hand corresponds to one of the hands based on Poker ranking he wins the corresponding award displayed on the paytable. The award is multiplied by the number of units bet. Video Draw Poker appears in a progressive jackpot form—a player qualifies for the progressive jackpot provided he wagers the maximum number of units permissible (usually 5).

There is a need for an electronic Poker game where players place a wager prior to the deal as in Video Draw Poker but may thereafter double and treble their original bet. Such a game would dramatically change the dynamics of strategy. Skillful play based on optimal strategy would reward a player by permitting him to increase his winnings two or three-fold. The game would appeal to players by providing the opportunity to make multiple wagers and decisions related to those wagers based on the progress of the game. Casino operators would welcome an innovation that results in an increase of the amount wagered.

In other types of slot machines such as the multi-reel slot machines, there is also a need to increase player participation and excitement in obtaining outcomes. According to present day machines, which may be electro-mechanical or of a video display type, the player makes a wager and the machine's processor selects an outcome which is displayed by mechanically rotating reels having indicia (and blank locations) thereon to align the indicia or blanks at a designated payline(s). For the video display version, the processor simulates the rotation of reels to produce the same result. Once initiated, the player has no input or control over the ultimate outcome. It would be advantageous to provide a method and device which would enable the player to participate in obtaining the outcome by giving the player an opportunity to increase their wager and discard one or more symbols from the initial display at the payline(s) and receive replacements therefor.

SUMMARY OF THE INVENTION

There is theref or provided according to the present invention a device and method for playing a game which increases the opportunity for the player to increase their wager during play and to discard at least a portion of an initial holding to attempt to better their final outcome. The method can be practiced in a live, table game format or by use of a device.

Accordingly, the method includes the player making a wager and initiating play by providing an initial holding to the player. The initial holding may be cards dealt by a dealer or symbols displayed at a display. The player is given the opportunity to increase their initial wager and to discard one or more of the components of the initial holding. Those components, e.g. cards, or symbols displayed, are replaced by replacement to produce a final outcome. If the final outcome is a designated winning outcome, the player receives a payoff based upon their wager(s) and if the outcome is a losing outcome the player's wager(s) are lost.

In a reel-type slot machine format, the method is practiced by the player making a wager and initiating play whereupon the gaming device randomly selects and displays at a payline(s) an initial holding as indicia on slot machine reels registering at the payline. The player assesses their initial holding and may stand or increase their wager to receive replacements for one or more of the indicia. If the player stands, the initial holding is the final outcome and the player wins or loses based upon that outcome. If the player has obtained a winning outcome, he is paid according to his wager and a predetermined paytable. If the player elects to increase their wager to receive replacements, they make their additional wager and select which indicia from the initial holding to discard (or hold) the indicia by respinning the reel(s) to produce a final outcome. If the player has obtained a winning outcome, they are paid based upon their initial and second wager and an established payout schedule. If the outcome is a losing outcome, the wagers are lost.

In a live table game format, the players each make an initial ante wager and a first outcome wager. The dealer deals cards to the players and a community hand to be shared by all players to make the best five card Poker hand. The dealing may be according to any one of the following formats of Table 1:

TABLE 1

| Format | Player's Cards | Community Cards |
|---|---|---|
| 1 | 2 cards, face down | At least 3 cards, one face up |
| 2 | 3 cards, face down | At least 2 cards, face down |

The players each assess their cards and opt to discard none, some or all of their cards which are replaced by cards dealt by the dealer to define each Player's initial holding. If the Players so wish they may place a second outcome wager in an amount corresponding to their first outcome wager and the dealer then reveals a first face down card of the community hand. The Players again each assess their hands and may opt place a third outcome wager and the dealer then reveals the remainder of the face down cards of the community hand. From the Player's cards and the cards of the community hand, each Player makes the highest ranking Poker hand they can which defines the Player's final outcome. The Player with the highest ranking outcome collects the ante wagers from the other Players. Each Player's outcome is also compared to a schedule of winning outcomes. If the Player has such an outcome, e.g. a four-of-a-kind, the Player receives a payout from the dealer according to a payout schedule.

BRIEF DESCRIPTION OF THE DRAWINGS

The feature and advantages of the various embodiments of a preferred gaming table and layout in accordance with the present invention is illustrated in the drawings wherein.

DESCRIPTION

Figure 1A:
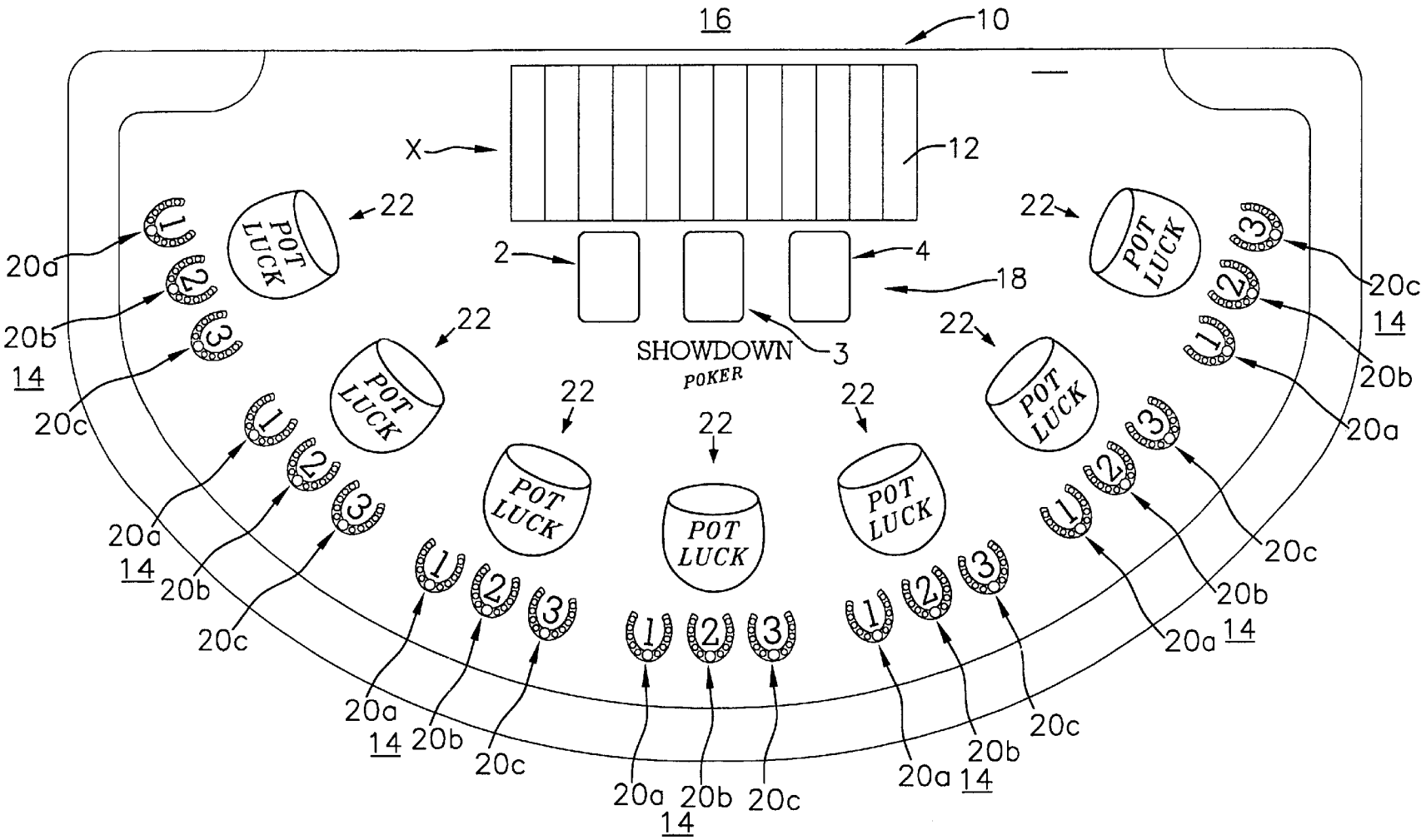
FIG. 1A is a top plan view of the gaming table layout for live table play of the various embodiments of the present invention.

In a preferred embodiment of the present invention a gaming layout 10 is provided having a surface as illustrated in FIG. 1 for playing the game of the method of the present invention using, preferably, a single deck of standard playing cards. The method employs the same basic priority or ranking of five card hands according to the rules of Poker familiar to players and as set forth in Table 2.

TABLE 2

| |
|---|
| Royal Flush |
| Straight Flush |
| Four-of-a-Kind |
| Full House |
| Flush |
| Straight |
| 3-of-a-Kind |
| Two Pair |
| One Pair |
| High Card(s) |

Referring to FIG. 1 the layout 10 (semi-circular) again a configuration familiar to players. A rack 12 is provided for housing the chips/checks used during play of the game of the method. The layout 10 has locations 14 for the players and a location 16 for the dealer. Between the dealer and player locations 16, 14 is an area 18 marked with indicia "2, 3 & 4" to define the areas wherein the community cards are positioned by the dealer during play of the game. The area 18 which designates the position of the dealer's/community cards can be denoted to position from two to five community cards. Where five community cards are used, the area 18 would have designations "2"–"6". Each player location 14 designates outcome wager areas 20*a–c* for the reception of players' chips. The outcome wager areas 20*a–c* may be denoted by horseshoe symbols situated in front of each player and identified by numerals "1, 2 & 3" to signify the numbers of wagers which may be made in the course of a round of the game. These numbered outcome wager areas 20*a–c* can number from two to five per player and be appropriately numbered in sequence, i.e. 1, 2 3 . . . but in the preferred embodiment of the game three outcome wager areas 20*a–c* representing three separate wagers. The outcome wager areas 20*a–c* need not be stylized in the form of a horseshoe and can be in the form of geometric shapes or bear, for example, the casino's logo.

As described below, the outcome wager(s) made by the players are directed to a paytable ranking of the final hand assembled by the player during play.

Directly in front of each player location 14 is an ante wager area 22 which may be denoted by a depiction of a Pot, labeled "Pot Luck". The ante wager area 22 receives the wager made by the player, not that he will obtain a hand of a certain ranking, but to compete against the other players at the table.

In the method of the game of the present invention, the objects of the method are twofold:

1) to make a Poker hand, using individual cards and the community cards, which corresponds to a predetermined paytable of hands, and;

2) to win the ante wagers at the table by assembling the highest ranking Poker hand among all the players at the table.

In the case of the first object, the house payment schedule, or paytable, lists a series of Poker hands with corresponding pay-offs. These payoffs correspond to the outcome wager(s) made by the player. Thus, with respect to the outcome wager(s) as hereinafter described, the player is playing against the house by trying to obtain a final hand which corresponds to one of the hands listed in the established paytable.

In the case of the second object and with respect to the ante wager, the player with the highest Poker hand showing wins the ante wagers. The ante wager is a bet solely between the players and does not involve a wager against or to be paid by the house (casino).

The Method of Play

At the start of each game and prior to receiving cards all players make their ante wager by placing their bet in area 22. Each player also places a first outcome wager in betting area 20*a*.

The dealer shuffles the cards and deals one community card face down in the area 18 on the layout marked "4" and deals each participating player one card, face-down. The dealer then places a second community card face-down in the area 18 marked "3" and deals the players a second card face-down. The dealer concludes the initial deal by placing a third community card, face-up, in the area 18 marked "2". The three cards in the area 18 denoted "2, 3 & 4" are community cards and are used by all players, with the cards dealt to the players, to assemble a five card Poker hand.

After the initial deal and examining their cards, each player has the option of discarding their first or second cards, or both, face down and receiving replacement cards therefor.

After all players have exercised their option to receive one or more replacement cards, each player in succession has the option to either (1) "stand" by making no further outcome wagers or (2) "raise" by wagering a second outcome wager in area 20*b*. When all players have exercised their option of placing second outcome wagers, a second community card in area 18 denoted "3" is revealed by the dealer. Players may again exercise their option to either (1) stand or (2) raise by making a third outcome wager in outcome wager area 20*c*. Making the third outcome wager is predicated upon the player having made the second outcome wager. That is, for the player to be eligible to place a third outcome wager, they must have made the second outcome wager.

An alternative version of the preferred embodiment of the game would be where each player is dealt three cards face down, which he has the option of discarding and receiving replacements, and the community hand would consist of two cards face down. In this version, the layout of which is shown in FIG. 1B, the method of play would be similar to that described above. After the deal of the initial three card hand to each player and after all players have exercised their option to receive one or more replacement cards, each player in succession has the option to either (1) "stand" by making no further outcome wagers or (2) "raise" by making a second outcome wager corresponding in value to their first outcome wager in area 20*b*. When all players have exercised their option of placing second outcome wagers, the first community card in area 18 denoted "2" is revealed by the dealer. At this point player may again exercise their option to either (1) stand or (2) raise. Players are entitled to raise if they had previously placed the second outcome wager. If so entitled and the player so opts, he places his third outcome wager in area 20*c*. The dealer then reveals the remaining community card.

The method is not limited to the above description/procedure with a deal relating to five cards per player, i.e. a two card player hand and three community cards. The deal can be composed of five to ten cards divided between the community cards and the cards each player receives; but in each case a player would still select five cards to constitute the highest ranking hand. A further variation of the deal consists in changing the mix of the number of cards dealt to the players and those that constitute the community cards. An example of a deal using seven cards and altering the mix of both community cards such as by each player receiving three cards (two cards face-down and one face-up or all three cards face down), and the community cards (the Flop) would comprise four cards, one face-up and three face-down.

Returning to the preferred embodiments described above, after all the community cards have been revealed, the players each turn over their cards. The outcome wagers are resolved first by the dealer comparing the player's final hand (the player's cards and the community cards) to a predetermined paytable of hands preferably related to the familiar ranking of Poker hands and as suggested by Table 1 above. The payoffs for each ranking and for each outcome wager made is as set forth in Table 3 below:

TABLE 3

| | |
|---|---|
| Royal Flush | 250 to 1 |
| Straight Flush | 100 to 1 |
| 4-Of-A-Kind | 25 to 1 |
| Full House | 9 to 1 |
| Flush | 7 to 1 |
| Straight | 5 to 1 |
| 3-Of-A-Kind | 3 to 1 |
| Two Pair | 2 to 1 |
| Jacks or better | Push |

Figure 1B:
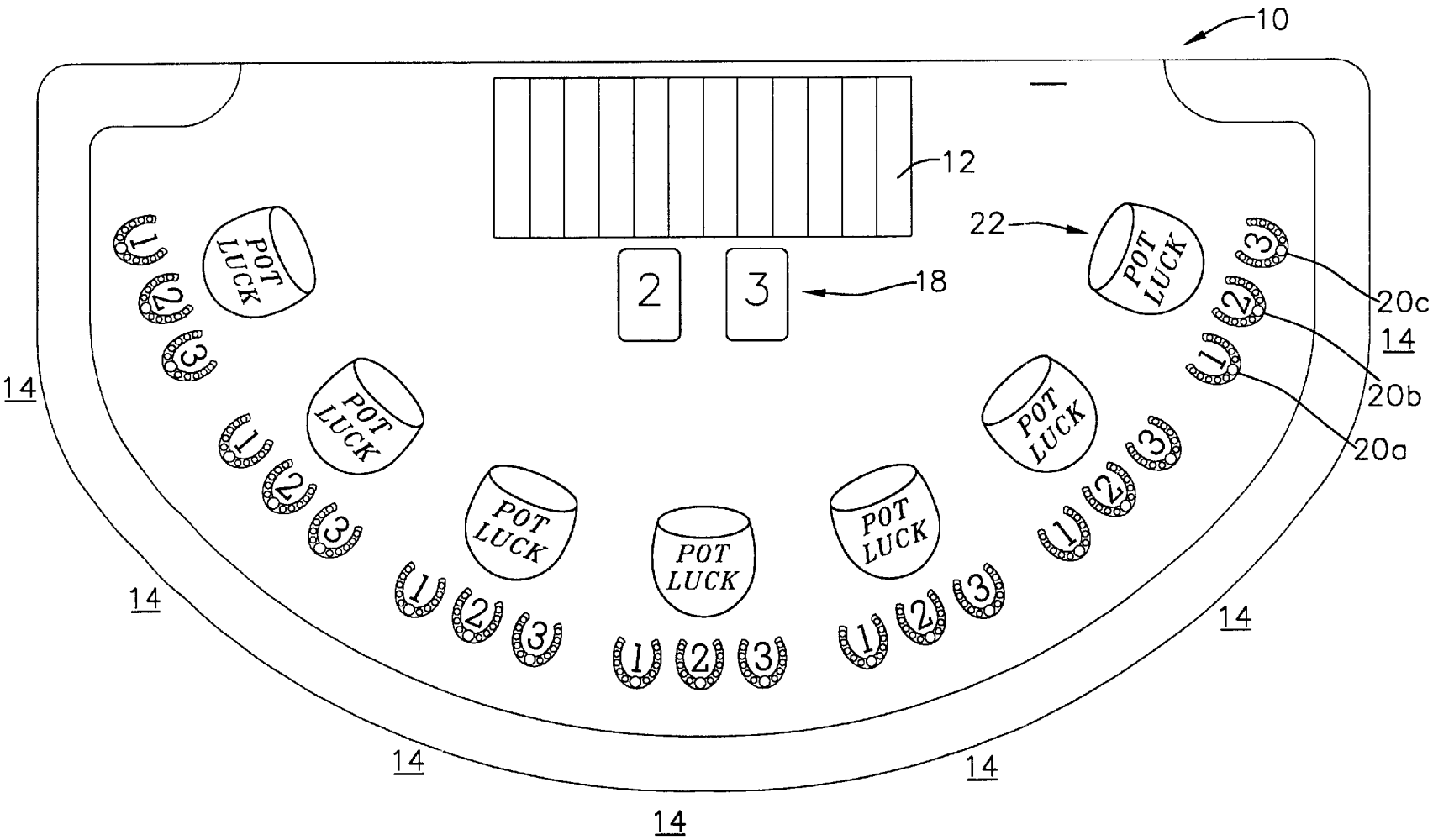
FIG. 1B is a top plan view of a gaming table layout for live table play of a further embodiment of the method of the present invention.

Referring to the preferred embodiment of the game exemplified in the layout FIG. 1A, Table 2 illustrates the pay-offs in relation to the list of Poker rankings applicable to the game. The house advantage is achieved because a difference exists between the true mathematical odds and the actual pay-offs. The method can be played by offering odds/pay-offs of a higher or lower order resulting in different vigourishes accruing to the house.

The method can include the addition of specific side wagers. An example of the addition of a wager is an optional wager whereby, if the first three cards of a player's hand comprises one of a number of select pre-determined combinations, he will receive specific pay-offs. In the above example applied to the preferred embodiment of the game, the combinations apply to the two cards dealt to a player and include the face-up community card or in the case where all community cards are face down, then the first community card revealed by the dealer. Alternatively where each player is dealt three cards face-down the additional wager will apply to the players three cards and not to any of the community cards. This wager applies to cards dealt only and not to discards and replacements.

The method can also include a progressive jackpot. The method would include an optional wager made at the start of each game, the object to win one to five high combinations e.g. Royal Flush, Straight Flush, etc.; a proportion of each such bet would be automatically added to a progressive jackpot displayed on a win meter. Those players that qualify as winners are paid out according to the current jackpot pay-table. Co-winners share the jackpot as an aggregate.

The jackpot can also be fixed and funded from the optional wager.

Alternatively, the outcome jackpot, progressive or fixed, can be funded as a portion from the mandatory ante wagers. For example, a levy would be assessed against the pot assembled from the ante wagers, that levy used to fund the jackpot.

A further embodiment of the present invention, wherein a progressive or fixed jackpot is a feature of the game, is so structured that the jackpot is divided into a primary jackpot with a Royal Flush being the winning combination and a secondary jackpot being awarded to the player who holds a specified ranked hand and is beaten by a player holding a higher ranked hand in the same round of play, i.e. a bad beat jackpot. The winner of the secondary jackpot will receive 50% of the running total displayed on the win meter; the player with the higher hand receives 25% of the running total and the balance is shared equally by the other players participating in that particular round of play.

After the outcome wagers have been resolved, the players' final hands are compared to determine which player has the highest ranking hand. The player having the highest ranking hand is awarded all of the ante wagers made. Players having equally ranked hands share equally in the award of the ante wagers.

Thus it can be seen that the players have multiple opportunities to win and can, by increasing their outcome wagers, increase the amount of their payoffs.

A further variation of the present invention consists of combining the jackpot bet with the ante bet. The method would be identical to that described in the foregoing paragraph with the highest hand taking the ante bets in all cases except the case of the secondary jackpot situation occurring. A proportion of the ante wagers would in each round of play be deducted from the winnings as a vigourish for the casino and an additional levy from the winnings to fund the jackpot.

Figure 2:
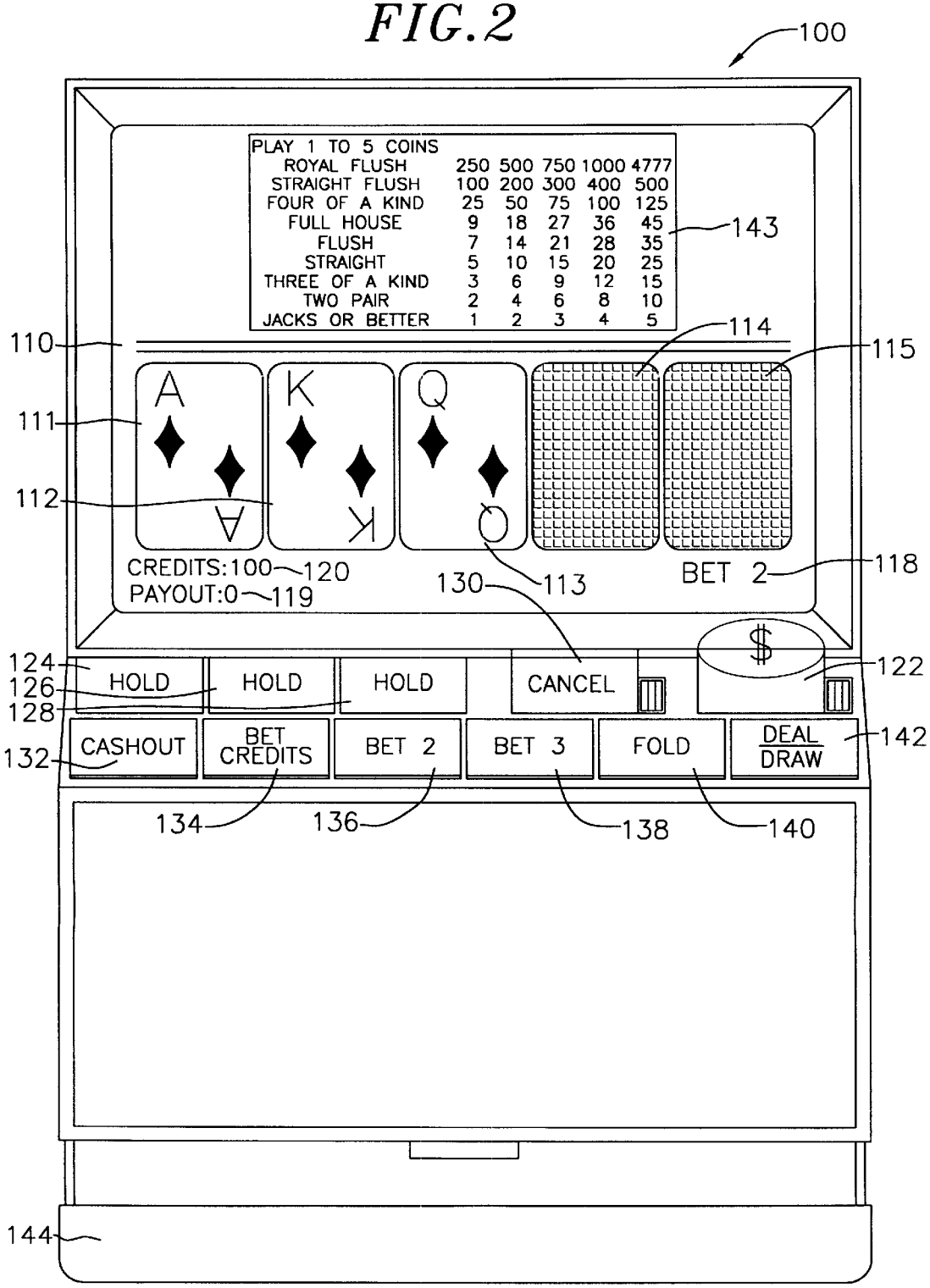
FIG. 2 shows an electronic device for playing the game according to the present invention.

The method, with reference to FIG. 2, can be adapted and played on a video game machine device 100 in various forms.

As depicted in FIG. 2, the electronic video poker device 100 includes a display screen 110 operative in a well-known manner controlled by a processor (not shown) of known design to display representations of conventional playing cards thereon. In accordance with the present invention, the processor of the device 100 is instructed pursuant to a program which may, for example, be stored in the PROM component of the internal circuitry. The processor is programmed to enable the electronic device 100 to play any one or more of the alternative embodiments of the method of the game described.

In a preferred embodiment of the device 100 of the present invention a video display screen 110 displays five cards 111, 112, 113, 114 and 115 randomly selected from a data structure containing data representing each card of a deck of fifty-two (fifty-three if the game is played in a Joker wild format) playing cards. The selected cards 111, 112 and 113 appear face-up and cards 114 and 115 appear face-down. In accordance with generally known technology in the field of video poker machines, the processor of the device 100, under program instruction, will accurately simulate the random dealing of the five screen card representations, 111–115, from a shuffled conventional fifty-two (or fifty-three) card deck.

The screen 110 displays at 118 the value of the current wager, for example, two tokens (which tokens may represent, for example, nickels, dimes, quarters, dollars, etc.) And similar displays 119 and 120 display the number of accumulated credits (i.e. tokens) and the number of tokens paid out, respectively. A coin acceptor 122 receives wager tokens, or alternatively, coins, bills or credit type cards. A plurality of control buttons 124, 126, 128, 130, 132, 134, 136, 138, 140 and 142 allow the player to make control inputs during play of the game of the present invention.

In an example of play of the electronic video poker device 100, a player first puts tokens or coins into the acceptor 122 to acquire a credit balance displayed at the credit display 119. If so desired, the player may alternatively place wagers individually before each hand of play by inserting coins, tokens, bills or by debiting a credit card. The player then initiates play by pressing the Deal/Draw button 142. This prompts the processor to select and display the player's five card hand on the video display screen 110. Cards 111, 112 and 113 appear face-up and cards 114 and 115 appear face-down. The displayed value cards 111–113 define an initial holding for the player. The player evaluates the initial holding and decides whether to hold some or all of the face-up cards. Should he decide to hold this he does by pressing the appropriate hold button(s) 124, 126 and 128 associated with each of the initial holding card position. By pressing the Draw button 142 the player receives replacements for cards he did not hold. The replacement cards are randomly selected from the card data structure (depleted of data representing the initial five cards selected). The displayed three cards, whether held or containing replacements, continue to define the player's initial holding. The player now has the choice of folding, by pressing the fold button 140. Should he fold the two face down cards 114 and 115 are revealed to display a final, five card Poker hand, outcome and, if he holds a winning Poker combination as defined by an established and displayed paytable 143, the player receives a payout at established odds. Should the player not have a winning final outcome, the wager is lost. Should the player, however, and based upon his initial holding, decide not to fold he may exercise the option of placing a second wager which he does by pressing the Bet Credits Button 134 or alternatively presses the button marked Bet 2 136 and inserts coins, tokens, bills in to the acceptor 122, equal in value to the amount he originally bet. If the player has exercised the option and placed a second bet, the fourth card 114 is revealed. Once again the player, having evaluated his four card hand, has the option of folding by pressing the Fold button 140. Should he fold the fifth card is revealed to define the final outcome and the player wins or loses based upon the combination of cards of the final outcome. Should the player decide not to fold he presses the "Bet 3" button 138 and enters the third wager, equal in value to his original bet, in the manner described above, or alternatively inserts coins, tokens or bills into the acceptor 122. The player then presses the deal/draw button 142 and the identity of the fifth card is revealed to define the final outcome. A "cancel" button 130 allows the player to correct a mistake or change his mind. A player may only place a third wager provided he had placed a second wager.

If the player holds a winning, final outcome, Poker combination as displayed on the device 10 he receives the appropriate odds. The odds are multiplied by the number of coins, tokens or bills bet except that the jackpot paid on a Royal Flush will be the amount displayed and the progressive jackpot will be the amount currently displayed on a meter. A player will only be eligible for the jackpot or progressive jackpot if he had bet the maximum number of coins permissible on his first wager. Paid out coins or tokens may be dispensed into a tray 144 for collection or storage by the player.

If the player does not obtain a winning final outcome all wagers are lost.

When a player wishes to cease play, any additional credits may be refunded by depressing the CASHOUT button 132.

The electrical device 100 may be programmed to limit the number of tokens/coins that can be wagered per bet per hand to, for example, five.

As may be readily understood, the device 100 may be modified and may be programmed to play other embodiments which incorporate the multiple wagering opportunities of the present invention as described above.

As yet a further embodiment, the device 100 may be programmed to, when initialized, display an initial hand of five cards with four cards face up and one card face down. The player would then opt to stand or raise. If the player stands, the fifth card is revealed defining the final outcome. If the player wishes to raise, they place a wager equal in value to their initial wager. The player may then hold none or up to all four of the initial cards. The cards which are not held are, when the deal draw button 142 is depressed, replaced with cards selected from the data of the remaining cards of the deck and the fifth card is revealed to result in the final outcome.

In still a further embodiment, the player is dealt an initial hand of five cards with three (or four) cards displayed face up. The player may opt to stand whereupon the remaining face down cards are revealed as the final outcome hand. Alternatively the player may be given the option of holding or discarding none up to all of the displayed cards and receive replacements therefor with the originally face down card(s) revealed to result in the final outcome. The player with their initial holding may also opt to double their wager whereupon they are provided with the opportunity to hold or discard the displayed cards of the initial holding. The held cards are replicated to a second hand which is represented by the second wager and the discrded card of the initial hand (J♢) is replaced and the first face down card is revealed. For example, if the player were initially dealt A♡, A♧, J♢, X, X (where "X" represents the face down cards, the player may opt to double their wager and hold the Aces whereupon the display would display the two hand in the following manner:

$2^{nd}$ Wager A♡ A♧ 10♧ A♢ X $1^{st}$ Wager A♡ A♧ 2♧ Q♤ X

The replacement cards for the discarded cards may be replaced from separate decks or from the same deck. That is, for the second wager hand, if a separate deck is used, it would be a deck whose data is redacted of the A♡, A♧ and J♢.

The player would then be provided with the option of standing, whereupon the remaining face down card is revealed producing two final outcomes, one for the hand of the first wager and one for the hand of the second wager. The player may also opt to place and third wager whereupon some or all of the cards of either the first or second wager hands is duplicated and the remaining face down card is revealed. For example, if the player makes a third wager, a three now completed hands would be displayed in the manner suggested below:

$3^{rd}$ Wager A♡ A♧ 10♧ A♢ A♤

$2^{nd}$ Wager A♡ A♧ 10♧ A♢ 10♢

$1^{st}$ Wager A♡ A♧ 2♧ Q♤ 4♤

The player is paid based upon the outcome of each hand. Further, as stated above, the face down and replacement cards may be selected from different or the same decks.

The method of play of the present invention can be applied to slot machines and comprises the innovative step of optional, additional wagering opportunities to conventional slot play. A slot machine may be programmed to play any of the embodiments of the present invention described above. The major distinction between the video poker embodiments and the slot machine embodiments is that in the former case cards are drawn from a standard deck and winning combinations are based on poker rank and, in the latter case, a plurality of reels bearing a plurality of symbols and/or numerals determine winning combinations.

Figure 3:
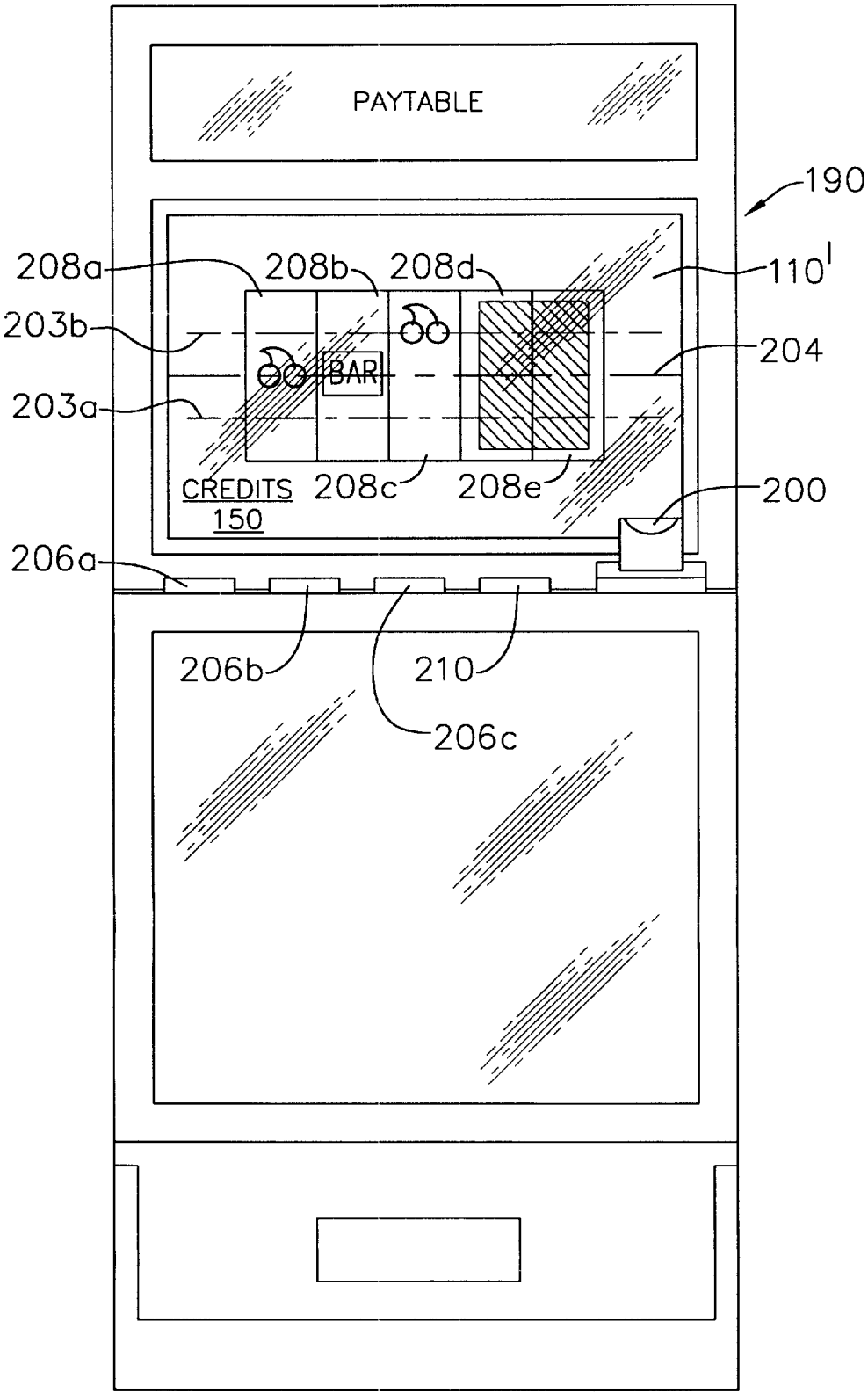
FIG. 3 shows an electronic device for playing the game according to a further embodiment of the present invention.

Referring to FIG. 3 another embodiment of the present invention is shown. The player enters their initial wager in any known fashion into the device 190 as by inputting token into a coin slot 200. The display screen 110' of the device 190 will, when activated, display indicia of five reels 208*a–e;* three reels 208*a–c* display indicia on the payline 204 will appear face-up and two indicia of reels 208*d–e* on the payline 204 will appear face-down as by displaying a cover 202 over the remaining reels 208*d–e.* Certain of the indicia or blanks on the reels 208*a–e* will be displayed at a designated payline 204. The player, as in the video poker version, has the initial option of discarding one or more of the presentations of the reels 208*a–c* at the payline 204 and receiving replacements therefor. The reel 208*a–c* presentations, which are discarded by using the action buttons 206*a–c,* are replaced by respinning of the discarded reels 208*a–c* to obtain a revised initial, three reel presentation at the payline 204.

After the player has discarded and obtained any revised initial holding, the player has the option of standing, doubling and trebling his initial wager. If the player elects to stand, he depresses an appropriate action button 210 and the cover 202 is removed revealing the remaining reels 208*d–e* indicia which are on the payline 204. Alternatively, the remaining reels 208*c–d* may spin to position their indicia (or blanks) at the payline 204 to define a final winning or losing outcome. If a winning final outcome is obtained, the player is paid according to established odds based upon the wager made. If the final outcome is a losing outcome, the player loses their wager.

If the player elects not to stand, they depress an action button and insert a second wager, preferably equal to their initial wager. After the second wager has been made the fourth reel 208*d* is spun or the cover 202 is partially removed to display a fourth reel 208*d* indicia or blank at the payline. The player may now elect again to stand by depressing action button 210 whereupon the fifth reel 208*e* is revealed to define a five reel, winning or losing, final outcome. If the final outcome is a winning outcome the player is paid based upon their first and second wagers. If the final outcome is a losing outcome, both of the player's wagers are lost.

Should the player elect not to stand, he depresses a suitable action button and inserts a third wager, preferably equal to the first wager as well. Upon acceptance of the third wager, the fifth reel 208*e* is spun or the cover 202 is removed to display an indicia (or blank) on the payline 204 to define the final, five reel, winning or losing, final outcome. If the final outcome is a winning outcome the player is paid based upon all three wagers and if the final outcome is a losing outcome, all three of the player's wagers are lost.

The method may be directed to a game having a single payline 204 or multiple paylines 203*a,b.*

A progressive jackpot feature may be incorporated into the device 190 or similar devices 190 linked to allocate a portion of the wagers to a progressive jackpot to be won based upon a obtaining a designated final outcome. The progressive may only be made available if the player has placed all wagers; or multiple progressive jackpots may be provided depending upon the number of wagers made by the player.

While I have shown a five reel slot machine it is to be understood that the method and device of the present invention could be used in a three reel or other multi-reel game.

In addition to the example embodiment of the invention described in detail above, other variants may also be practiced within the scope of the present invention comprising additional, optional wagering opportunities. Standard slot machines where all indicia appear face-up on the display screen can be adapted to incorporate multiple wagering opportunities whereby players can either double their initial bet or double and treble their initial bet. The innovative method of play of the present invention can be applied to standard slot machines irrespective of the number of reels, and would comprise the player placing an initial bet, pressing the spin button or pulling a handle which activates the random generation of indicia on the display screen. Having examined his "hand" the player has the option of holding or receiving replacements for some or all of the indicia on the reels. According to the present invention the player would, in addition, have the option of doubling his initial wager.

Should the player decide to double his initial bet he does so accordingly and then presses the spin button and receives replacements for any indicia discarded. The option to place a second wager is conditional on the player making at least one discard of his original "hand." The application of the method of play of the present invention relating to the innovative step of an optional additional wager is applicable to any slot machine configuration in terms of:

(a) the number of reels per machine and the number of indicia per reel.

(b) any permutation re face-up and face-down indicia.

(c) any permutation re pre-determined winning combinations of indicia in the form of symbols or numerals.

(d) any permutation re the number of pay-lines displayed, be they horizontal, vertical or diagonal.

The method of play of the present invention can be applied to both video machines and slot machines where touch-screen technology has replaced button input. In addition the method of play of the present invention can be applied to video machines and slot machines that incorporate bonus bets or jackpots and progressive jackpot features linked to wheel components.

Still further the method may be modified by providing the player with the option of, if they have made the second or third wagers, discarding the indicia revealed upon making such a wager. For example, in the embodiment shown in FIG. 2, upon making a second wager the fourth card is revealed. At this point the player is presented with either holding or discarding the fourth card. If the card is discarded it is replaced before providing the player with the option of making the third wager. Similarly, if the player makes a third wager and the fifth card is revealed, the player is presented with an option of discarding or holding the fifth card to define the final outcome.

This same method of holding or discarding subsequently revealed indicia can also be applied to reel-type slot machines.

It is to be understood that the present invention is subject to many modifications and changes without departing form the spirit and scope of the appended claims.

I claim:

1. A method for playing an electronic video Poker card game comprising:

the player making an initial wager to participate in the game;

providing a processor to control the play of the game and a data structure including data representing a deck of playing cards;

the player prompting play of the game, said processor in response to prompting randomly selecting from the data structure and displaying at an electronic display three cards face up;

the player discarding one to three of the face up cards, said processor replacing the discarded cards with replacements selected from the data structure;

the player opting to (1) fold whereupon the processor reveals a fourth and a fifth card to present a five card hand or (2) place a second wager whereupon the processor reveals a fourth card to present four cards and the player opting to (a) fold whereupon the processor reveals the remaining fifth card to present a five card hand or (b) place a third wager whereupon the processor reveals the remaining fifth card to present a five card hand; and the processor comparing the five card hand of revealed cards with a schedule of winning hands stored in a second data structure and if the five card hand is a winning hand paying the player based upon his wager (s).

2. The method of claim 1 comprising the processor, when prompted for play by the player, randomly selecting five cards and controlling the display to display the selected cards with three face up and the fourth and fifth cards face down.

3. An electronic device for playing a game based on playing cards comprising:

a processor including a data structure storing data representing each card of a deck of playing cards and winning five card hands;

a display;

means for accepting a wager by a player and for prompting play;

said processor programmed to, in response to prompting of play, randomly select and display at the display three playing cards;

means for the player to discard one to three of the displayed cards, said processor randomly selecting replacement cards from the data structure and controlling the display to the replacement card(s) for the discarded cards;

a control for the player to select to fold or wager, (1) said processor in the event the player selects to fold controlling the display to display a fourth and a fifth card to present a final five card hand and (2) in the even the player selects to wager and makes a second wager via the wager accepting means, said processor controlling the display to display a fourth card;

said control, where a player has made a second wager, providing the player with the option to fold or wager, (1) said processor in the event the player selects to fold controlling the display to display a fifth card to present a final five card hand and (2) in the even the player selects to wager and makes a third wager via the wager accepting means, said processor controlling the display to display a fifth card to present a five card hand; and said processor comparing the five card hand to the data representing winning hands and if the player has obtained a winning five card hand issuing a pay out to the player.

4. A method for playing a casino game comprising:

the player making an initial wager to participate in the game;

presenting a partial outcome to the player consisting of at least two exposed indicia representing an initial holding, said indicia randomly selected from a field of indicia, at least three exposed indicia representing a final outcome;

the player opting to stand or raise, (i) if the player stands revealing the remaining indicia to define a final outcome and (ii) if the player opts to raise, the player making a second wager and holding one to all of the initial holding, said held indicia replicated into a second hand and (iii) completing each of the initial and second hand holdings with additional indicia selected from the field to define first and second final outcomes; and comparing each of the final outcomes to a schedule of winning final outcomes and if the player has obtained a winning final outcome paying the player based upon their wager(s) and if the player has not obtained a winning final outcome collecting the player's wager(s).

5. The method of claim 4 wherein presenting said indicia includes providing a display of a partial outcome as at least three playing cards and providing said winning outcomes based upon the ranking of final outcome, five card hands of Poker.

6. The method of claim 5 including, providing an initial display of three cards of a five card Poker hand, the player opting to place a second wager or stand, if the player stands revealing the remaining two cards to define a five card, final outcome, Poker hand, if the player makes a second wager, the player opting to hold none to three of the displayed cards;

replicating any held cards into a second displayed hand and selecting additional cards to complete each of the first and second hands to four exposed cards;

the player opting to place a third wager or stand, ifthe player stands, selecting and displaying for each of the first and second hands a fifth card to complete each hand to displayed five card final outcomes;

if the player opts to place a third wager, replicating some of the displayed cards of the initial and second hands into a third hand and revealing the remaining cards for all three hands to define three five card, final outcome, Poker hands;

comparing each of the fmal outcomes to said schedule of winning outcomes; and for each winning final outcome paying the player based upon the ranking of the five card Poker hand(s).

7. A method for playing a casino game comprising:

the player making an initial wager to participate in the game;

presenting a partial outcome to the player consisting of at least two exposed indicia representing an initial holding, said indicia randomly selected from a field of indicia, at least three exposed indicia representing a final outcome;

the player opting to stand or raise, (i) if the player stands revealing the remaining indicia to define a fmal outcome and (ii) if the player opts to raise, the player making a second wager and holding one to all of the initial holding and (iii) completing the initial holding with additional indicia selected from the field to define a final outcome; and comparing the final outcome to a schedule of winning final outcomes and if the player has obtained a winning final outcome paying the player based upon their wager (s) and if the player has not obtained a winning final outcome collecting the players's wager(s).

* * * * *